US005794746A

United States Patent [19]

Ketonen et al.

[11] Patent Number: 5,794,746

[45] Date of Patent: Aug. 18, 1998

[54] DOOR SILL ARRANGEMENT IN AN ELEVATOR CAR

[75] Inventors: Ari Ketonen, Hyvinkää; Harri Anttila, Jokela, both of Finland

[73] Assignee: Kone Oy, Helsinki, Finland

[21] Appl. No.: 864,674

[22] Filed: May 28, 1997

[30] Foreign Application Priority Data

May 28, 1996 [FI] Finland ..... 962231

[51] Int. Cl.[6] ..... B66B 13/06

[52] U.S. Cl. ..... 187/333; 49/120

[58] Field of Search ..... 187/333, 334, 187/325; 49/116, 120

[56] References Cited

U.S. PATENT DOCUMENTS 5,139,111 8/1992 Baumann et al. ..... 187/333

5,165,505 11/1992 Hayashi et al. ..... 187/333

FOREIGN PATENT DOCUMENTS 6-127875A 5/1994 Japan .

*Primary Examiner*—Kenneth Noland

*Attorney, Agent, or Firm*—Birch, Stewart, Kolasch & Birch, LLP

[57] ABSTRACT

A door sill arrangement for an elevator has a profiled sill element with upper and lower grooves. First and second door panels of the elevator are provided with first and second sliding guides, respectively. The first and second sliding guides move in the upper and lower grooves of the profiled sill element when the doors are opened. Upper and lower plastic bars are attached to the first and second sliding guides, respectively. The upper and lower plastic bars are pulled by the front sliding guides, when the door panels are opened. The upper and lower plastic bars slide along through the upper and lower grooves and substantially fill or cover the grooves which would otherwise be exposed when the door panels are opened.

13 Claims, 3 Drawing Sheets

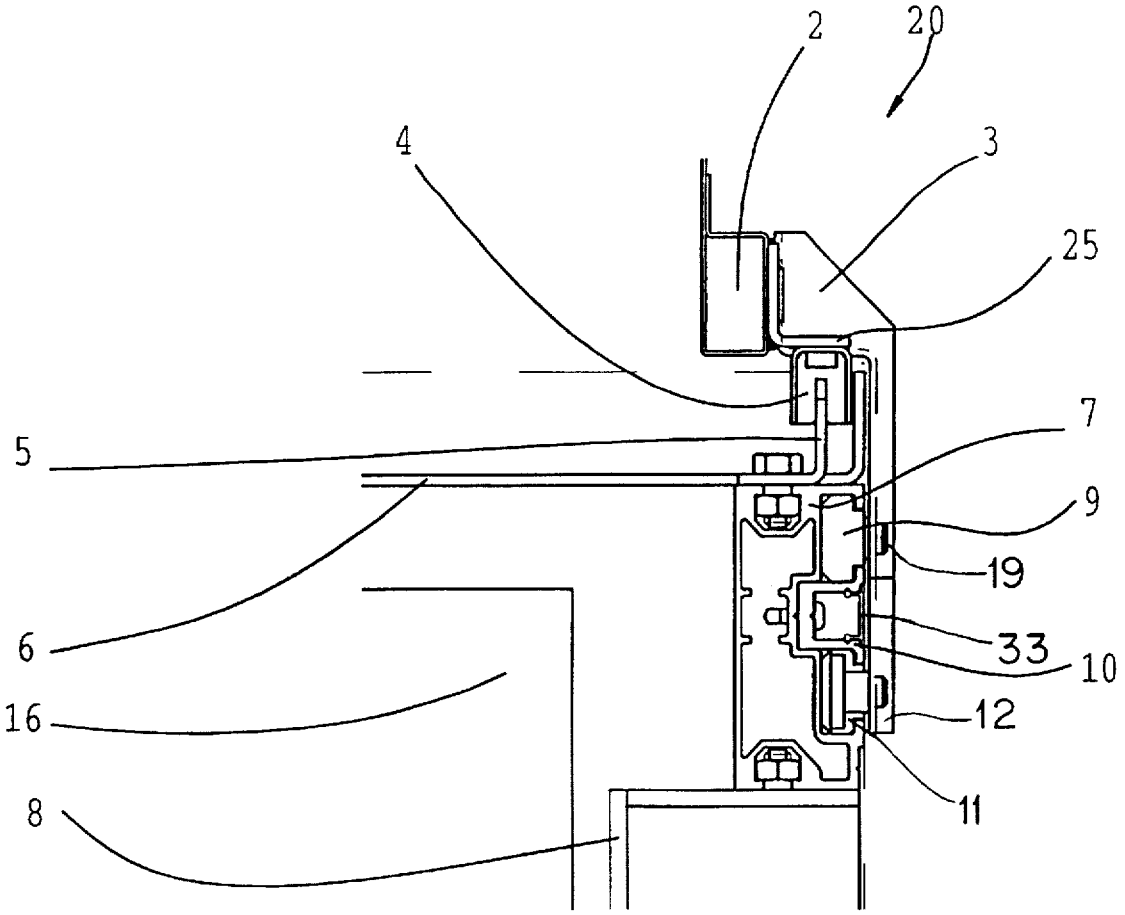
Fig 1.a
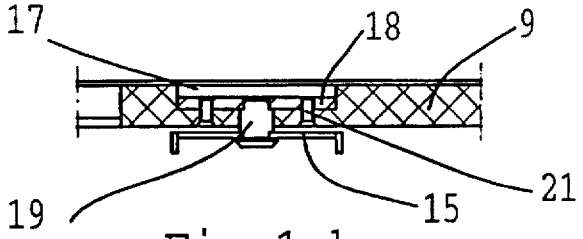
Fig 1.b
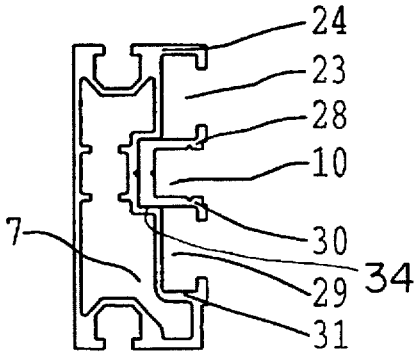
Fig 1.c

DOOR SILL ARRANGEMENT IN AN ELEVATOR CAR

BACKGROUND OF THE INVENTION

1. Field of the Invention

The present invention relates to a door sill arrangement for an elevator car.

2. Description of the Background Art

The door sill of an elevator car is generally made of profiled aluminium or a steel tube structure with a groove for the sliding guides of the door panels. Such a door sill structure always remains visible. Some find this visually unacceptable.

In the elevator car, the profiled aluminium element, termed aluminium profile in this application, is attached to the car frame structure. On the landing the aluminium profiled element is attached to the door sill base plate or to the shaft wall, by means of bolts. The aluminium profile is also provided with holes to allow litter to fall down. Such a sill structure is not favored by architects because the aluminium profile is exposed to view when the door is open, partly exposed to view when the door is closed, and also because the groove gathers litter and dirt.

In some cases, the door sill is implemented using a narrow aluminium profile which is hid from view under the door panels when the door panels are closed. However, the narrow aluminium profile is still visible when the door panels are open. It is also possible to attach to this aluminium profile, a mat strip consisting of a narrow profiled aluminium strip. The door material is fixed under the mat strip.

SUMMARY OF THE INVENTION

The object of the present invention is to eliminate the drawbacks referred to above. The door sill arrangement of the invention has the following advantages.

- easy to extend the floor material right up to the sill clearance
- only the edge of the sill plate is visible when the doors are open
- no uneven surface; e.g. useful in hospitals
- no dirt can accumulate inside the door sill profile
- a smooth surface on the side of the shaft
- permits advance opening of the doors, because in this case the grooves are covered by closing elements
- prevents the accumulation of litter.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1*a* presents a landing door sill in side view,

FIG. 1*b* shows how the upper and lower plastic bars are attached to frames of the first and second front sliding guides, FIG. 1*c* presents the upper, middle, and lower grooves of the first aluminium profile.

DETAILED DESCRIPTION OF THE PREFERRED EMBODIMENTS

Figure 2:
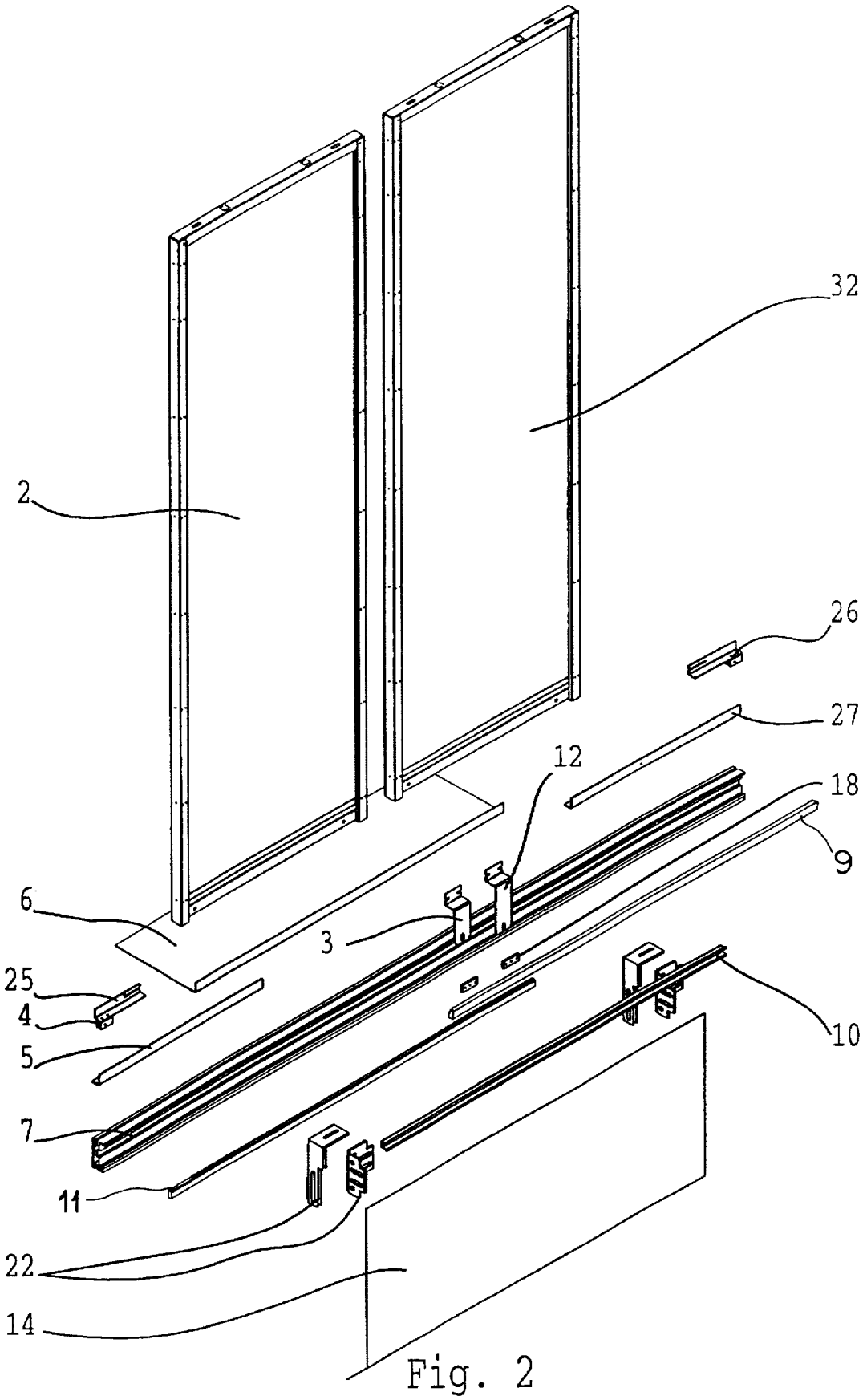
FIG. 2 presents the parts of the door sill of the invention in an exploded view.

FIG. 1*a* shows a door sill arrangement 20 according to the invention in side view. The door sill profile is composed of two separate profiled aluminium elements or aluminium profiles. The first aluminium profile 7 is mounted between a sill base plate 6 and sill brackets 8. A first door panel 2 is provided with a first front sliding guide 3 mounted on a lower edge of the first door panel near a side edge facing toward the door opening. Preferably the first front sliding guide 3 is attached to the first door panel 2 by means of screws. To the first front sliding guide 3 is attached an upper plastic bar 9. The upper plastic bar 9 is fitted into an upper groove 23 in the first aluminium profile 7. The upper plastic bar 9 is a straight elongated closing element for closing the upper groove 23. The upper plastic bar 9 is attached to the first front sliding guide 3 by means of an anchor pin 19. As shown in FIG. 1*b*, the anchor pin 19 is fastened to a metal plate 18 with screws 21.

As shown in FIG. 2, a second front sliding guide 12 is identical to the first front sliding guide 3 except that it is longer, extending from a second door panel 32 to a lower groove 29 of the first aluminium profile 7. The second front sliding guide 12 is mounted on the lower edge of door panel 32 near the side edge facing to the door opening. The second front sliding guide 12 is attached to a lower plastic bar 11 by means of an anchor pin. The first and second front sliding guides 3,12 are preferably connected at their lower ends to the upper and lower plastic bars 9,11, respectively. The joints between the anchor pins and the front sliding guides 3,12 have a free play that allows upward and downward movement. The elongated plastic bars could be replaced with bands or belts.

Back sliding guides 25,26 are preferably placed in lower parts of outer edges of the first and second door panels and attached to the first and second door panels 2,32 by means of screws. The back sliding guides 25,26 slide along guide bars 5,27 which are mounted directly above the first aluminium profile 7. A sliding element 4, consisting of a piece of plastic provided with a groove, is attached to each of the back sliding guides 25,26 by means of screws.

Fitted into a middle groove 34 in the middle part of the first aluminium profile 7 is a second aluminium profile 10. Fitted in the lower groove 29 below it is the lower plastic bar 11. The second aluminium profile 10 is attached to the first aluminium profile 7 by means of thread cutting screws and has a protective plastic cover 33 in front of it. When the upper and lower plastic bars 9,11 become worn or dirty and must be replaced in connection with maintenance, the protective plastic cover 33 is first removed from the second aluminium profile 10. Next, the thread cutting screws behind the plastic cover 33 are unscrewed. Finally, the second aluminium profile 10 can be easily removed and the upper and lower plastic bars can be replaced. Also attached with thread cutting screws to the first aluminium profile 7, is also a toe guard 14. In the bottom left corner of FIG. 1*a*, the raw edge 16 of the shaft opening is also visible.

FIG. 1*b* illustrates the attachment of the upper plastic bar 9 to first front sliding guide 3. Located in the upper plastic bar 9 is an empty space 17. Placed on the bottom of this space is the metal plate 18 for fastening screws 21. The anchor pin 19 connects a frame part 15 of the first front sliding guide 3 to the metal plate 18. In a corresponding manner, the lower plastic bar 11 is attached with an anchor pin to the second front sliding guide's frame part. In FIG. 1*b*, only the attachment of first front sliding guide 3 is shown, because both the first and second front sliding guides 3 and 12 are mounted in the same way and they are identical in structure, except that second front sliding guide 12 is somewhat longer because it must extend from the second door panel 32 to the lower plastic bar 11.

FIG. 1*c* shows the upper and lower grooves 23,29 in which the upper and lower plastic bars move. The walls of upper groove 23 are formed by an upper front edge 24 of the first aluminium profile 7 and an upper edge 28 of the second aluminium profile. Lower groove 29 is correspondingly formed by a lower front edge 31 of the first aluminium profile 7 and a lower edge 30 of the second aluminium profile. The second aluminium profile 10 is placed in the middle groove 34.

FIG. 2 shows the parts of the door sill of the invention in an exploded view. The door sill includes first and second door panels 2,32, below them the door sill base plate 6, the first aluminium profile 7, attached to it the first and second front sliding guides 3,12, the upper and lower plastic bars 9,11, the toe guard 14, the second aluminium profile 10, the back sliding guides 25,26, the guide bars 5,27, and a number of different hold fixtures 22, which-may vary in accordance with a design and hole layout as each case requires. The hold fixtures 22 serve to attach the door sill to the wall.

Figure 3A:
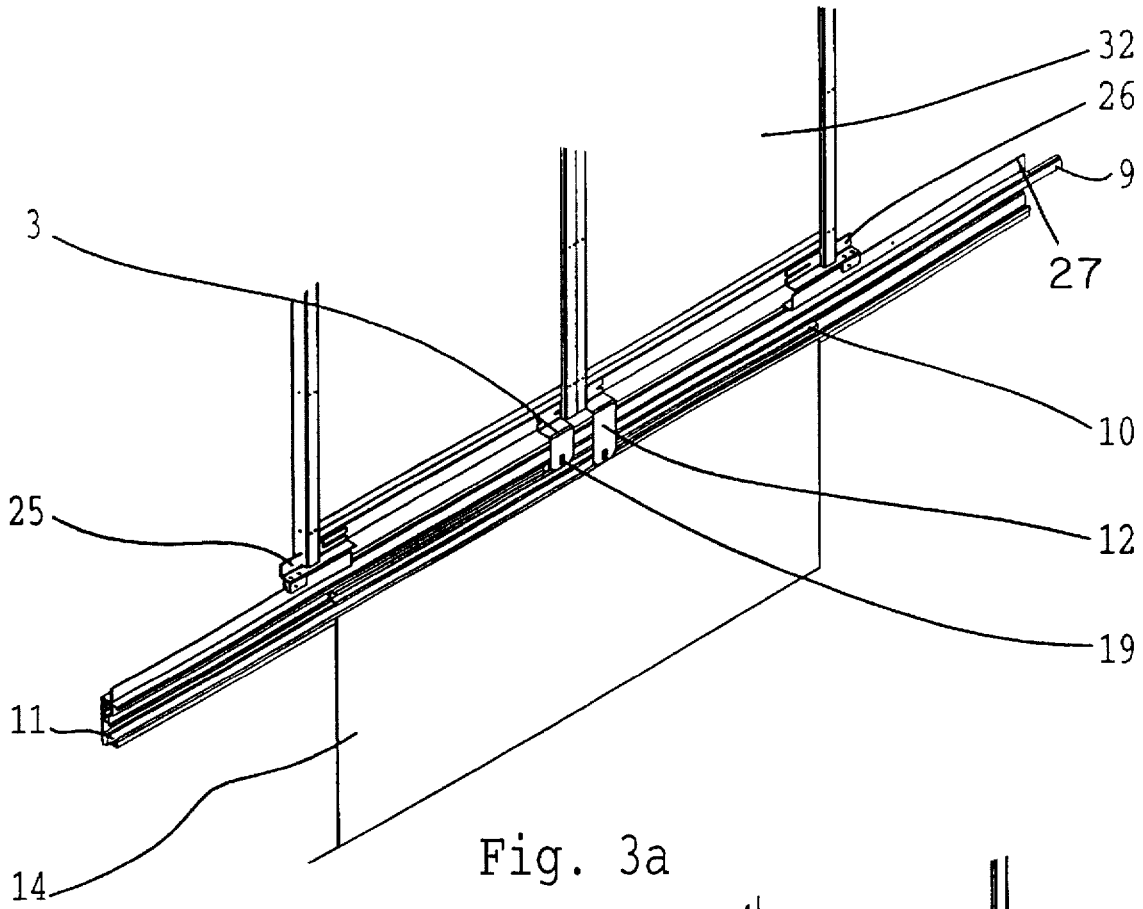
FIGS. 3*a* and 3*b* illustrate the operation of the door sill of the invention.
Figure 3B:
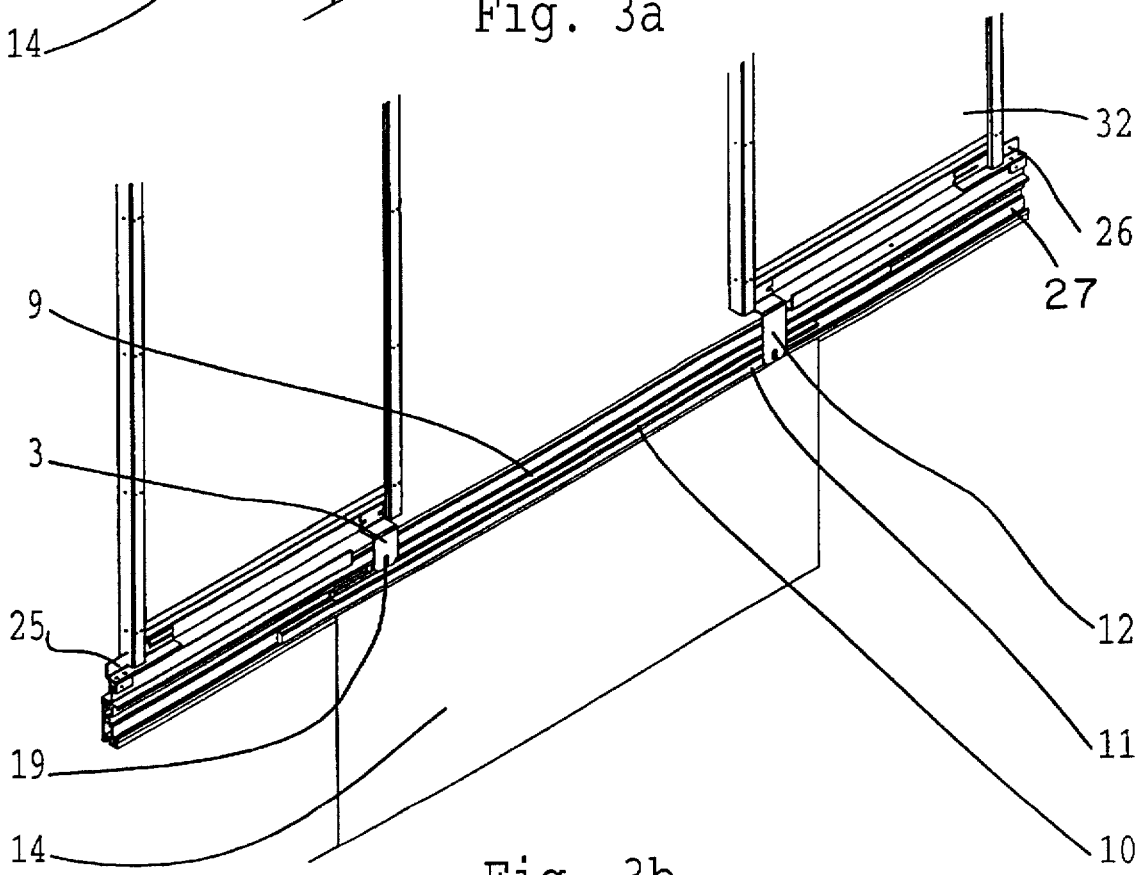

FIGS. 3*a* and 3*b* illustrate the operation of the door sill of the invention. When the first and second door panels 2,32 are opened, the first and second front sliding guides 3,12 attached to them move with the first and second door panels 2,32 towards the edges of the door opening. At the same time, the upper and lower plastic bars 9,11 attached to the first and second front sliding guides 3,12 move into the door opening area, thus closing the gaps of the upper and lower grooves 23,29 in the door opening area. When the doors are closed, the upper and lower plastic bars partially overlap each other. The first and second front sliding guides 3,12 are connected to the ends of the upper and lower plastic bars 9,11. The first front sliding guide 3 being attached to the left-hand end of the upper plastic bar 9 and second front sliding guide 12 being attached to the right-hand end of the lower plastic bar 11.

Advance opening of the first and second door panels is allowed, which means that the opening movement of the first and second door panels can be started before the elevator car has reached the landing level. When advance opening occurs, the upper and lower plastic bars 9,11 do not yet cover the door opening completely. The upper and lower grooves 23,29 for the first and second front sliding guides 3,12 can be fitted in the lateral surface of the door sill profile 7. When the door is completely open, a flat and smooth surface is formed, leaving only the edge of the door sill plate visible.

It is obvious to a person skilled in the art that different embodiments of the invention are possible. The invention is not limited to the examples described above, but can be varied within the scope of the claims presented below. For example, the aluminium profiles can be replaced with roll formed sections and the frame parts of the back sliding guides can be integrated into a single part. The plastic guides can also be manufactured by extrusion moulding techniques. The hold fixtures can also be implemented using simpler structures.

We claim:

1. Door sill arrangement for an elevator car, comprising:

a profiled sill element provided with a groove;

a sliding guide of a one door panel cooperating with said groove for guiding movement of the door panel; and a closing element associated with said groove for covering said groove in said profiled sill element when the door panel is moved to an open position.

2. The door sill arrangement for an elevator car as defined in claim 1, wherein said closing element is attached to said sliding guide.

3. The door sill arrangement for an elevator car as defined in claim 2, wherein said closing element extends in a direction opposite a direction in which the door panel moves when moved to the open position.

4. The door sill arrangement for an elevator car as defined in claim 1, wherein said closing element is fitted in said groove of said profiled sill element.

5. The door sill arrangement for an elevator car as defined in claim 4, wherein said closing element is a bar which, in the open position of the door panel, extends substantially across any exposed portion of said profiled sill element.

6. The door sill arrangement for an elevator car as defined in claim 1, wherein said groove is fitted on a lateral side surface of said profiled sill element.

7. The door sill arrangement for an elevator car as defined in claim 1, wherein said groove is fitted on a top surface of said profiled sill element.

8. The door sill arrangement for an elevator car as defined in claim 1, wherein said closing element is a plastic bar.

9. An elevator landing arrangement comprising:

a profiled sill element provided with an upper groove and a lower groove;

a first elevator door panel and a second elevator door panel;

a first sliding guide attached to said first elevator door panel, said first sliding guide having a first portion located adjacent said upper groove;

a second sliding guide attached to said second elevator door panel, said second sliding guide having a second portion thereof located adjacent said lower groove;

an upper closing element attached to said first portion of said first sliding guide, said upper closing element being located in said upper groove; and a lower closing element attached to said second portion of said second sliding guide, said lower closing element being located in said lower groove, wherein said first elevator door panel is moveable and said second elevator door panel is moveable, said first elevator door panel being moveable in a first direction opposite to a second direction of movement of said second elevator door panel, whereby when said first and second elevator door panels are moved, said upper and lower closing elements cover said upper and lower grooves in substantially all of an area of the profiled sill located between the first and second elevator door panels.

10. The elevator landing arrangement as defined in claim 9, wherein said upper and lower closing elements are plastic bars.

11. The elevator landing arrangement as defined in claim 9, wherein said profiled sill element consists of a first and a second aluminium profile, said second aluminium profile being fitted to said first aluminium profile so that the combination of the first and second aluminum profiles forms said upper and said lower grooves.

12. The elevator landing arrangement as defined in claim 9, wherein said upper and lower grooves are fitted on a lateral side surface of said profiled sill element.

13. The elevator landing arrangement as defined in claim 9, wherein said upper and lower grooves are fitted on a top surface of said profiled sill element.

* * * * *